United States Patent [19]

Imai et al.

[11] 4,269,052

[45] May 26, 1981

[54] MECHANICAL DESCALING DEVICE

[75] Inventors: Isao Imai; Hiromasa Hirata, both of Yokohama; Takao Kawanami; Yasuhiro Omura, both of Tokai, all of Japan

[73] Assignees: Ishikawajima-Harima Jukogyo Kabushiki Kaisha; Nippon Steel Corporation, both of Tokyo, Japan

[21] Appl. No.: 38,262

[22] Filed: May 11, 1979

[30] Foreign Application Priority Data

Jun. 9, 1978 [JP] Japan ..... 53-69627

[51] Int. Cl.[3] ..... B21B 45/06; B08B 3/02

[52] U.S. Cl. ..... 72/39; 29/81 B; 72/201; 134/122 R

[58] Field of Search ..... 29/81 A, 81 B; 72/39, 72/40, 201; 134/64 R, 122 R; 266/113

[56] References Cited

U.S. PATENT DOCUMENTS

| | | | |
|---|---|---|---|
| 2,211,981 | 8/1940 | McBain et al. | 72/201 |
| 2,696,823 | 12/1954 | Scott | 134/122 R |
| 3,151,197 | 9/1964 | Schultz | 134/122 R X |
| 3,289,449 | 12/1966 | O'Brien | 266/113 X |
| 3,511,250 | 5/1970 | Gallucci et al. | 29/81 A |
| 4,132,393 | 1/1979 | Nakamura et al. | 266/113 X |

FOREIGN PATENT DOCUMENTS

| | | | |
|---|---|---|---|
| 51-86029 | 7/1976 | Japan | 72/39 |
| 51-95938 | 8/1976 | Japan | 72/39 |
| 52-15421 | 2/1977 | Japan . | |
| 52-26509 | 7/1977 | Japan | 72/201 |
| 53-80358 | 7/1978 | Japan . | |

*Primary Examiner*—Ervin M. Combs

*Attorney, Agent, or Firm*—Scrivener, Clarke, Scrivener and Johnson

[57] ABSTRACT

A device for blasting descaling slurry jets against the surfaces of sheet metal is disclosed, thereby descaling the same prior to cold rolling.

8 Claims, 11 Drawing Figures

MECHANICAL DESCALING DEVICE

BACKGROUND OF THE INVENTION

The present invention relates to a mechanical descaling device for continuously descaling hot rolled sheet metal before it is subjected to the cold rolling.

In the cold rolled sheet metal production lines, a coil of hot rolled sheet metal is first uncoiled and scales on the surfaces of sheet metal must be completely removed before the sheet metal is subjected to the cold rolling which further reduces the sheet metal to a desired gage.

In general, in the conventional cold rolled sheet metal production lines, the uncoiled hot-rolled sheet metal is made to pass through a body of an acid such as hydrochloric or sulfuric acid to chemically remove the scales on the surfaces of sheet metal. Such chemical descaling process takes a long time and is inefficient. Furthermore, it requires additional installations for recovering and neutralizing the used acid so that the overall length of the chemical descaling line (to be referred to as "pickling line" in this specification) becomes very long. Moreover, the pollution problems due to the use of strong acids must be taken into consideration. Therefore because of high capital cost and running cost, the production cost of cold rolled sheet metal becomes very expensive.

There exists a further disadvantage of the pickling line. That is, the pickling line is in general not continuous with the cold rolling line. As a result, after passing through the pickling line, the sheet metal must be recoiled and transported to a storage area, from where the coils of sheet metal must be transported again by cranes or trucks to the cold rolling line. Therefore, there must be provided a large space between the pickling and cold rolling lines in order to store the coils of sheet metal temporarily. Furthermore, during the storage of coils, rust may be formed on the sheet metal due to the attack by the pickling acid remaining on them. To overcome this problem, a device is disposed downstream of the pickling line so as to apply an anti-rusting oil to the sheet metal as it emerges from the pickling line.

Various methods have been proposed in order to directly connect the pickling line with the cold rolling line, thereby attaining a high productivity. All of the methods however have encounted the following problems.

(1) The rate with which the pickling acid dissolves the scales on the sheet metal is generally constant so that the sheet metal must continuously be moved at a constant velocity through a huge pickling vessel which is considerably long in length. On the other hand, the velocity of the sheet metal entering the first cold rolling stand in the cold rolling line must be varied depending upon various cold rolling conditions and requirements such as a reduction ratio. Thus, it is next to impossible to continuously connect the pickling line and the cold rolling line through which the sheet metal must be moved at different velocities.

(2) When the sheet metal passes through the pickling line at a velocity lower than a predetermined velocity, over-descaling occurs and the poor yields result. Furthermore, the degradation in quality and variations in properties of the sheet metal result because of the strong attack by the pickling acid. The overconsumption of the pickling acid also results in the resultant increase in pickling cost.

Since the cold rolling line must be shut down periodically to replace the rolls according to a pass schedule, a considerably hugh accumulator for temporarily accumulating a suitable length sheet metal must be installed both upstream and downstream of the pickling line.

(3) The pickling acid remaining on the sheet metal may attack the parts of the devices following the pickling line. Fumes of pickling acid evolving from the pickling line may attack the equipment and devices, especially the rolling motors, around the pickling line.

As described above, the realization of a continuous cold rolled sheet metal production line with a pickling line is very difficult. Therefore, many efforts have been made to provide mechanical descaling devices combined with a cold rolling line for the purpose of continuous production of cold rolled sheet metal from a coil of hot-rolled sheet metal. In one of the mechanical descaling devices so far proposed, a descaling slurry made of abrasive particles is blasted together with water under high pressure against the surfaces of sheet metal through nozzles. However, these nozzles are in general fixed so that not only the angle between the axis of the nozzle and the centerline of the sheet metal being descaled cannot be varied, but also the angle between the nozzle axis and the plane of the sheet metal cannot be varied at all. Moreover, the distance between the nozzle tip and the surface of the sheet metal cannot be varied. As a result, the conditions of descaling operations cannot be varied depending upon the dimensions, properties and desired surface conditions of sheet metal, thus resulting in waste in energy and undesired surface quality. Furthermore, with the fixed nozzles, the inspection and maintenance become difficult. When it is desired to change the angles of the nozzles and the distance between the nozzle tip and the sheet metal, the production line must be completely shut down, thus resulting in the decrease in productivity.

SUMMARY OF THE INVENTION

Accordingly, the main object of the present invention is to provide an improved mechanical descaling device which may substantially overcome the above and other problems encountered in the prior art devices.

BRIEF DESCRIPTION OF THE FIGURES

Other objects and advantages of the present invention will become apparent from the following description of some preferred embodiments thereof taken in conjunction with the accompanying drawings, in which.

DETAILED DESCRIPTION

Figure 1:
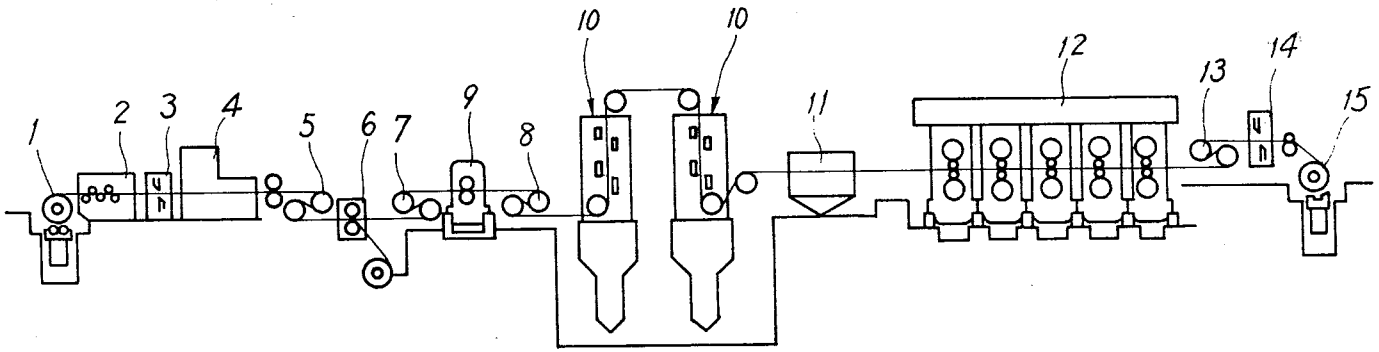
FIG. 1 is a schematic diagram of a continuous cold rolled sheet metal production line with mechanical descaling devices in accordance with the present invention.

Same reference numerals are used to designate similar parts throughout the figures.

Figure 2:
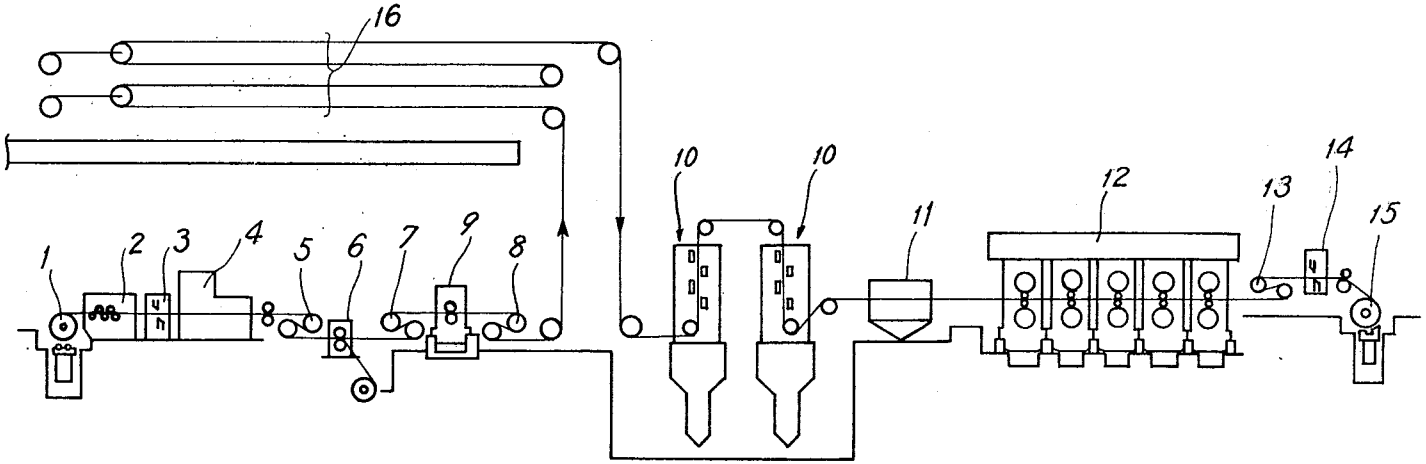
FIG. 2 is a schematic diagram of another example of the continuous cold rolled sheet metal production line with mechanical descaling devices in accordance with the present invention.

Referring to FIGS. 1 and 2, reference numeral 1 denotes a recoiling device such as a payoff reel; 2, a flattener; 3, an upcut shear; 4, a flush butt welder; 5, a bridle roll; 6, a side trimmer such as a scrap borer or a chopper. In the conventional descaling lines, the side trimmer 6 has been disposed downstream of the pickling station, whereas in accordance with the present invention, it is disposed upstream of a mechanical descaling apparatus in order to attain energy saving. The control of tension exerted on the sheet metal is effected by a conventional electrical system.

Downstream of the side trimmer 6, bridle rolls 7 and 8 are disposed longitudinally spaced apart from each other, and disposed therebetween is a scale breaker 9 which has a dual function of (a) correctly reshaping the sheet metal or steel S and (b) reducing the same under high reduction pressure with a reduction ratio of more than 6% so as to uniformly and highly efficiently descale the sheet metal S. The scale breaker 9 may be a skin pass mill or a leveller. In the conventional descaling lines, with a skin pass mill, the reduction ratio is on the order of 1% at most, but it is to be emphasized that according to the present invention the reduction ratio is higher than 6%.

Downstream of the scale breaker 9 are disposed a plurality of sets of mechanical descaling devices 10. They mechanically descale the surfaces of the sheet metal S so that the sheet metal S may be subjected to the cold rolling. The mechanical descaling devices 10 may be selected from various types such as liquid honing, shot blasting, buff rolling and so on. In the descaling line shown in FIG. 1, the liquid honing type descaling devices 10 are employed. As will be described in detail hereinafter, each of the descaling devices 10 normally blasts a descaling slurry made of iron sand or the like against the surfaces of the sheet metal S through nozzles. Simultaneously, it also blasts the water under high pressure (on the order of 25 to 200 kg/cm$^2$ G) through different nozzles so as to cause the descaling slurry to accelerate toward the surfaces of the sheet metal S. Thus the mechanical descaling devices 10 may highly efficiently descale the sheet metal S.

Downstream of the mechanical descaling station consisting of the descaling devices 10 is disposed an after-treatment device 11 for blasting fresh and clean water under high pressure against the surfaces of the sheet metal S, thereby removing the descaling slurry attached thereon.

Downstream of the after-treatment device 11 is disposed a continuous cold rolling line 12 consisting of a plurality of cold rolling mills arranged in tandem. The cold rolled sheet metal emerges from the cold rolling line 12, passes bridle rolls 13 and an upcut shear 14 and is rolled around a recoiling device 15 which exerts suitable tension to the sheet metal S and aligns the edges thereof when rolled around.

In addition to the above explained devices, the descaling line shown in FIG. 2 further includes an accumulator 16 between the bridle rolls 8 and the mechanical descaling station 10. The accumulator 16 is disposed downstream of the welder 4 so that the former will not interfere with the operation of the welder 4 for joining the trailing edge of the preceding sheet metal and the leading edge of the following sheet metal and the operations following the welder 4.

Figure 3:
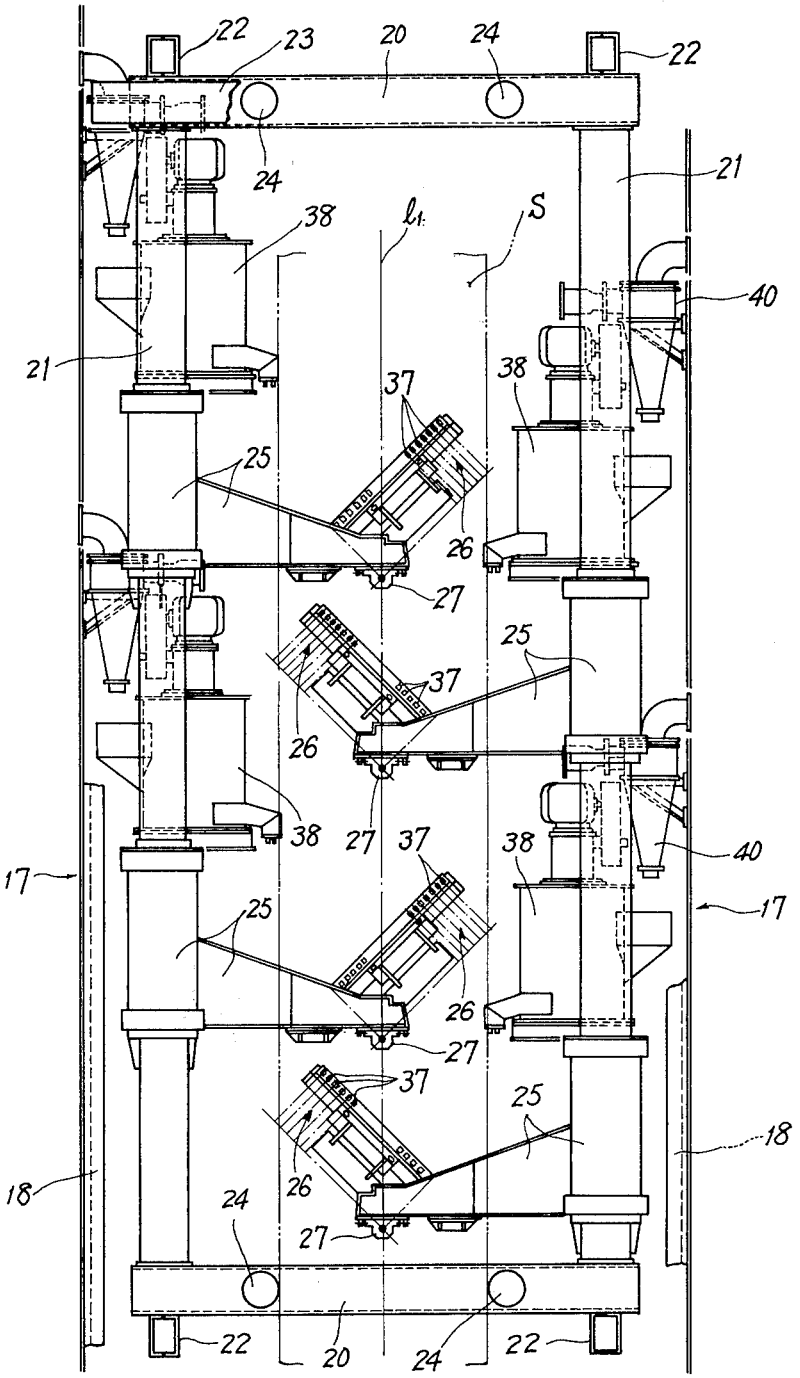
FIG. 3 is a front view of a first embodiment of a mechanical descaling device in accordance with the present invention.

Next referring to FIGS. 3, 4 and 5, the mechanical descaling device 10 will be described in detail. Suitable sheet metal transport means is provided so that the sheet metal S may pass through a vertical casing 17 from top to bottom. Rails 20 are securely attached with brackets (not shown) to columns 18 and extended in parallel with the surfaces of the sheet metal S. Within the space defined by four columns 18 is disposed a movable frame constituted of four pipe-shaped columns 21 disposed at the corners of the frame and connected to each other with beams 22 and 23. The transverse beams 23, which are extended in parallel with the surfaces of the sheet metal S, are provided with wheels 24 riding on the rails 20. Hydraulic cylinders (not shown) are operatively coupled to the beams 22 in parallel with the rails 20 in such a way that as the hydraulic cylinders are extended or retracted the movable frame may travel transversely along the rails 20 in parallel with the surfaces of the sheet metal S.

Rotary arms 25 are mounted on the columns 21 in such a way that they may be rotatable about the axes of the columns 21, each rotary arm 25 carrying a nozzle assembly 26. Of the four nozzle assemblies 26 shown in FIG. 3, two are used for descaling one surface of the sheet metal S while the other two for descaling the other surface thereof. That is, as best shown in FIG. 4, the uppermost nozzle assembly 26 is so arranged as to descale the right half (from the centerline $l_1$)of one surface of the sheet metal S while the second nozzle assembly 26 is arranged for descaling the left half thereof. In like manner, the third nozzle assembly 26 is so arranged as to descale the right half of the other surface of the sheet metal S whereas the fourth or lowermost nozzle assembly, the left half therof. It is of course possible to extend the width of a nozzle assembly 26 to such an extent that one nozzle assembly may descale the whole surface of the sheet metal. Furthermore, the descaling nozzle assemblies 26 may be in any number and may be disposed in any suitable array as needs demand.

Figure 4:
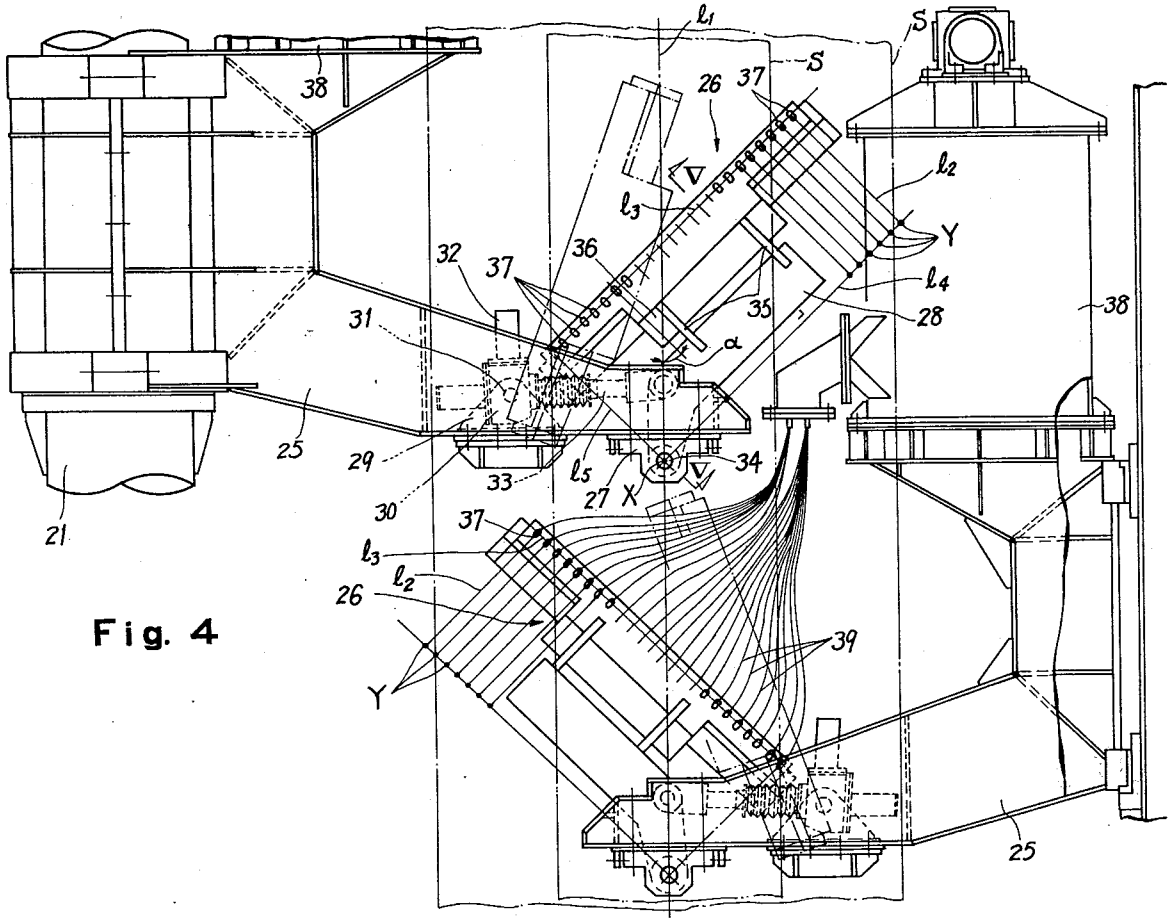
FIG. 4 is a fragmentary front view, on enlarged scale, of the first embodiment of the device illustrating its arrangement of nozzle assemblies.

A shaft 34 carries a box-shaped supporting member 28 and is journalled in bearings 27 securely attached to the lower surface of the rotary arm 25 adjacent to the free end thereof in such a way that the axis X of the shaft 34 may perpendicularly intersect with the centerline $l_1$ of the sheet metal S as best shown in FIG. 4.

Referring particularly to FIG. 4, a worm gearing or reduction gear 30 has its casing pivoted with pins 31 to a bracket 29 which in turn is mounted on the rotary arm 25 about halfway between its ends. The worm wheel of the reduction gear 30 is operatively coupled to a motor 32 while the worm shaft 33 has its one end pivotably connected to the supporting member 28 at a point above its shaft 34. Therefore as the motor 32 is driven to rotate the worm wheel in either direction the worm shaft 33 is extended toward the right in FIG. 4 or toward the left so that the supporting member 28 is caused to swing about the shaft 34 in the clockwise or counterclockwise direction away from or towards the column 21. The nozzle assembly 26 is extended upwardly obliquely at an angle relative to the vertical or the centerline $l_1$ of the sheet metal S.

Still referring to FIG. 4, a nozzle mounting block 36 is mounted with a pair of traversely spaced apart brackets 35 in parallel with the supporting member 28. A plurality of nozzle bodies 37 are mounted on the block 36 and spaced apart by a suitable distance from each other in the transverse direction. These nozzle bodies 37 are hydraulically communicated through respective flexible hoses 39 with a mixing chamber 38 mounted on the top of the rotary arm 25 (See FIG. 3). The nozzle bodies 37 are so arranged that their nozzle axes $l_2$ intersect the straight line $l_4$ at Y, said straight line $l_4$ being the projection on one or the other surface of the sheet metal S of a line which is extended in parallel with the straight line $l_3$ connecting the tips of the nozzle bodies 37 and intersects the axis X of the shaft 34 at right angles thereto (See also FIG. 5). Furthermore the extension of the nozzle axis $l_5$ of the innermost nozzle body 37 coincides or passes the point (indicated by X in FIG. 4) at which the projected straight line $l_4$ intersects the centerline $l_1$ of the sheet metal S.

In FIG. 4 there is shown the angle $\alpha$ at which the nozzle axis $l_2$ of each nozzle body 37 intersects the centerline $l_1$ of the sheet metal S. This angle $\alpha$ may be arbitrarily varied in the manner described elsewhere depending upon the descaling conditions such as the width of the sheet metal S. Therefore the points Y may be varied at which the descaling slurry jets blasted out of the nozzles impinge against one or the other surface of the sheet metal S.

Figure 5:
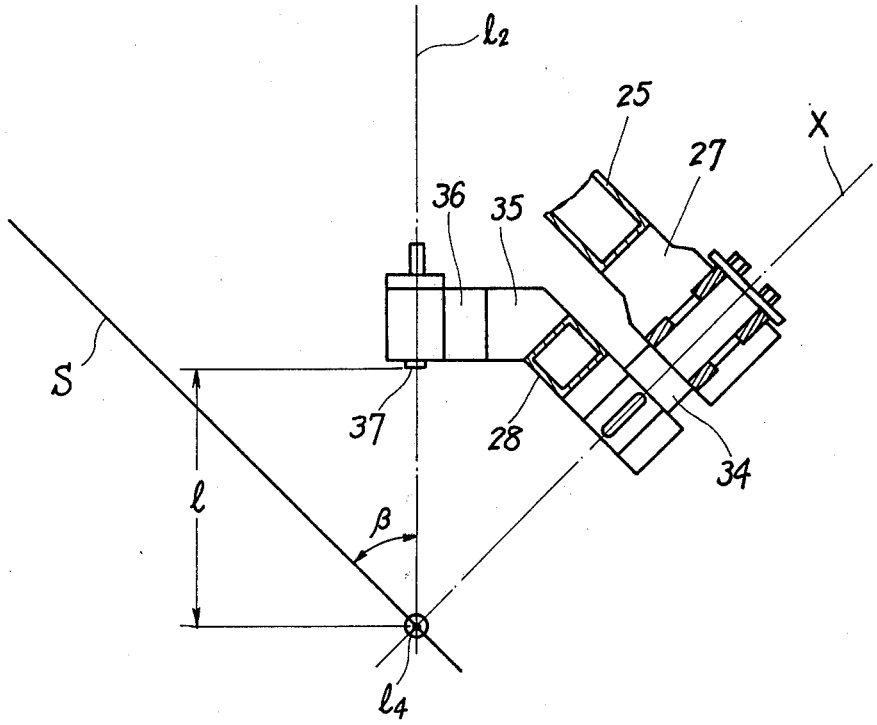
FIG. 5 is a view as viewed in the direction indicated by the arrows V in FIG. 4.

Referring to FIG. 5, there is shown the angle $\beta$ at which the nozzle axis $l_2$ of each nozzle body 37 intersects the plane of the sheet metal S. This angle $\beta$, which will be referred to as "the incident or impinging angle" is fixed to an optimum angle and cannot be varied. The traveling distance l between the nozzle tip and the surface of the sheet metal is also fixed to an optimum distance and cannot be varied.

A means (not shown) is provided to supply the water under high pressure to the nozzle bodies 37 so that the descaling slurry may be blasted and impinged against the sheet metal S at a high speed. Furthermore, a suitable descaling slurry receiving means such as a tank is disposed below the casing or stationary frame 17 so as to collect the blasted descaling slurries.

Referring back to FIG. 3, the descaling slurry is charged into the mixing chamber 38 through a cyclone 40 which has a function of condensing the descaling slurry.

Referring back to FIGS. 1–5, the mode of operation of the descaling line with the descaling devices 10 described in detail hereinbefore will be explained. The coil of sheet metal S is uncoild by the uncoiling device 1, and flattened by the flattener 2. The off-gage portion at the leading edge of the sheet metal S is cut off by the upcut shear 3 in such a way that the cut-off leading edge may be perpendicular to the axis or centerline $l_1$ of the sheet metal S. The flush-butt welder 4 welds the leading edge thus prepared by the upcut shear 3 to the trailing edge of the preceding sheet metal S which has been similarly edge prepared. Thereafter the side trimmer 6 cuts off the sides of the sheet metal S. The scale breaker 9 mechanically descales the sheet metal S in the manner described in detail elsewhere so that the optimum descaling effects may be attained by the mechanical descaling devices 10. In addition to the previous descaling, the scale breaker 9 has a function of flattening the sheet metal S by the reduction under high pressure of the bending. Otherwise, when the sheet metal S with the waving or undulating surfaces passes the deflector rolls in the mechanical descaling devices 10 under tension, its surfaces pass zig-zag courses so that desired descaling effects cannot be attained.

The sheet metal S emerging from the scale breaker 9 may be temporarily accumulated in the accumulator 16 as shown in FIG. 2 before it is fed into the mechanical descaling device 10.

In the mechanical descaling device 10, the angular position of each nozzle assembly 26 must be adjusted depending upon the width of the sheet metal S. To this end, the motor 32 is energized so as to extend or retract the worm shaft 33 in the manner described in detail elsewhere, whereby the nozzle assembly 26 may be brought to an optimum angular position as indicated by the solid lines in FIG. 4.

The descaling slurries are charged through the flexible hoses 39 from the mixing chamber 38 to the nozzle main bodies 37 and mixed with the water under high pressure which is supplied separately as described elsewhere. Thus the descaling slurry jets under high pressure are blasted and impinged against the surfaces of the sheet metal S so that scales may be completely removed.

If the sheet metal S oscillates in the widthwise directions when passing through the mechanical descaling device 10, the nozzle axis $l_5$ of the lowermost nozzle body 37 fails to intersect the centerline $l_1$ of the sheet metal S. As a result, the nozzle assemblies 26 cannot attain the descaling of the right and left halves of one or the other surface of the sheet metal S. To overcome this problem, according to the present invention, means for sensing the widthwise oscillations of the sheet metal S is provided so that in response to this sensing means the movable frame (consisting of the columns 21 and the beams 22 and 23) is moved along the rails 20 in parallel with the sheet metal S so that the axis X of each nozzle assembly 26 may perpendicularly intersect with the centerline $l_1$ of the sheet metal S (See FIG. 4) and consequently at least one pair of nozzle assemblies 26 may descale the right and left halves of one or the other surface of the sheet metal S.

When the sheet metal S has a relatively small width, the motor 32 is energized to drive the worm shaft 33 in such a direction that the supporting member 28 is swung about the axis X to increase the angle $\alpha$. Thus the nozzle assembly 26 is brought to the angular position indicated by the two-dot chain lines in FIG. 4 and effectively cover the right or left half of one or the other surfaces of the sheet metal S with a relatively small width. Even though the angular position of the nozzle assembly 26 has been changed, the intersection between the nozzle axis $l_5$ of the lowermost nozzle body 37 and the centerline $l_1$ of the sheet metal S remains unchanged from X in FIG. 4. Thus even when the angular positions of the nozzle assemblies 26 are changed, there will not result any area on one or the other surface of the sheet metal S upon which the descaling slurry jets from both the nozzle assemblies 26 spontaneously impinge. Furthermore there will be no area left upon which neither of the descaling slurry jets from the nozzle assemblies 26 impinge. Thus the whole surfaces of the sheet metal S may be descaled.

During the descaling operation, the rotary arms 25 are maintained in their operative position with pins or the like (not shown). In order to inspect the nozzle assembly 26, the stop pin or the like is removed to permit the rotary arm 25 to rotate about the column 21 so that the nozzle assembly 26 may be extended outwardly of the stationary frame 17. Since the mixing chamber 38 is mounted on the top of the rotary arm 25, it is not needed to remove the flexible hoses 39 from the nozzle assembly 26 when the latter is moved out of its operative position in the manner described above.

After the sheet metal S has been completely descaled by the mechanical descaling devices 10, it is thoroughly cleaned with the fresh water under high pressure in the after-treatment device 11 and then cold rolled in the cold rolling line 12 (See FIGS. 1 and 2). The cold rolled sheet metal S is applied with an anti-rusting oil when it passes the deflector roll 15, and is recoiled again by the recoiling device 16. When the sheet metal S is wound into a roll with a predetermined diameter, the upcut shear 14 is operated to cut off the sheet metal S.

Figure 10:
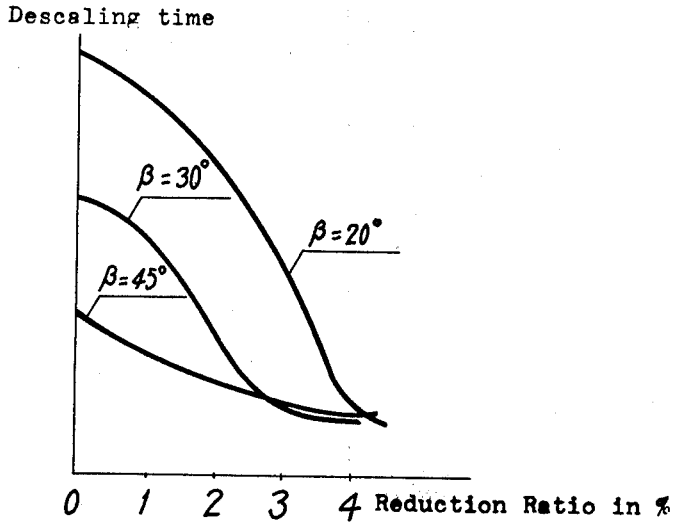
FIGS. 10 and 11 show graphs used for the explanation of the descaling device in accordance with the present invention.

Next referring particularly to FIG. 10, there is explained the reason why the sheet metal S is subjected to the reduction under high pressure in the scale breaker 9 before it is fed into the mechanical descaling device 10. When the reduction ratio becomes from 6 to 8%, the complete descaling may be effected within a short time with any incident or impinging angle $\beta$ from 20° to 45°. For instance with the incident angle of 45°, the descaling time is reduced by almost one half when the sheet metal has been reduced by from 6 to 8% in the prior art. In other words, the descaling efficiency may be doubled.

Figure 11:
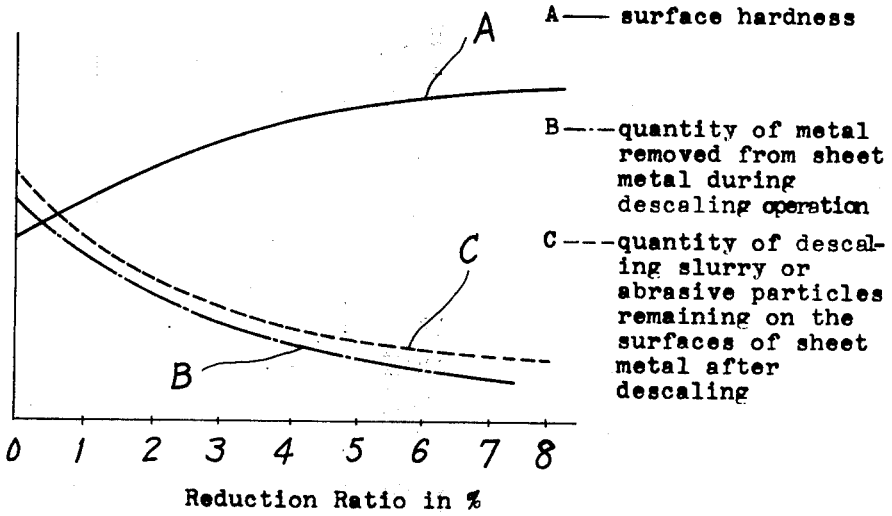

Furthermore, as indicated by the solid line A in FIG. 11, the higher the reduction ratio, the higher the surface hardness of the sheet metal S becomes. As a consequence, the quantity of the metal removed from the sheet metal S during the descaling operation may be reduced as indicated by the one-dot line curve B in FIG. 11. That is, the high yield may be ensured. In addition, as the surface hardness increases, the penetration of the abrasive particles into the surfaces of the sheet metal S may be reduced as indicated by the broken line curve C in FIG. 11 so that the ratio of the quantity of abrasive particles remaining on the surfaces of the sheet metal S to the total quantity of abrasive particles impinged against them may be considerably reduced.

As described hereinbefore, according to the present invention the descaling and cold rolling may be continuously carried out from the uncoiling of the hot rolled sheet metal to the recoiling of cold rolled sheet metal. As a result, the recoiling and uncoiling devices just before the cold rolling line 12 may be eliminated. Furthermore the accumulator such as loop cars may be eliminated. Moreover, since the mechanical descaling devices 10 of the present invention may highly effectively and efficiently descale the sheet metal, the pickling apparatus including its associated equipment may be eliminated. Consequently, the coil storage between the pickling line and the cold rolling line may be eliminated and means for transporting the coils from the pickling line to the cold rolling line may be also eliminated. Thus, the whole cold rolled metal sheet production line starting from the uncoiling device and ending at the recoiling device through the steps of sizing, descaling, surface cleaning and cold rolling may be made very compact in size. Furthermore, savings in energy and materials may be attained. That is, the drying device following the pickling line may be eliminated. Furthermore, after having been descaled, the sheet metal S is immediately applied with a lubricating oil and is subjected to the cold rolling. As a result, the oiling device for applying an anti-rusting oil to the sheet metal as it has been emerged from the pickling apparatus may be eliminated.

Referring back to FIGS. 1 and 2, the side trimmer 6 is disposed upstream of the mechanical descaling devices 10. This means that the sheet metal S to be descaled is shorter in width than the sheet metal as uncoiled, so that the energy required for descaling the sheet metal whose sides have been cut off is less than when the sheet metal as uncoiled is fed into the descaling device.

Prior to descaling by the mechanical descaling devices 10, the sheet metal S is made to pass through the scale breaker 9 so that it may be corrected in shape and reduced at a high reduction ratio as described above. As a result, the density or distribution of scales on the surfaces of the sheet metal may become uniform so that the uniform and highly efficient descaling by the mechanical descaling devices 10 may be effected. Furthermore, since the scale breaker 9 trues the shape of the sheet metal, the descaling at high speeds may be ensured.

Furthermore, the angular positions of the nozzle assemblies 26 may be optimumly varied depending upon the width of the sheet metal to be descaled in the manner described elsewhere, and the properties of the descaling slurry and the blasting or impinging pressure of the descaling slurry jets may be optimumly varied depending upon the properties of the sheet metal to be descaled. Moreover the maintenance and inspection of the nozzle assemblies 26 may be effected without stopping the cold rolled sheet metal production line if required so that the high productivity may be ensured.

SECOND EMBODIMENT, FIGS. 6 AND 7

While the first embodiment described above with reference to FIGS. 3–5 may vary its angle $\alpha$, the second embodiment to be described in detail below with reference to FIGS. 6 and 7 may vary not only the angle $\alpha$ but also the descaling slurry incident or impinging angle $\beta$ even during the descaling operation.

As in the case of the first embodiment, the box-shaped supporting member 28 is carried for swinging movement by the shaft 34 which in turn is journalled by the bearings 27 attached to the rotary arm 25.

A three-dimensionally constructed parallel linkage or a pantograph is mounted on the supporting member 28. That is, it comprises a pair of two-dimensional parallel linkages each comprising, as shown in FIG. 7, two parallel cranks 44 and 45 and two parallel connecting rods 48 and 51. The lower ends of the cranks 44 and 45 are pivoted to shafts 42 and 43 which in turn are journalled by spaced brackets 41 and are extended in parallel with the longitudinal axis of the supporting member 28. One end of the connecting rods 48 and 51 is pivoted to shafts 46 and 49, respectively, which are extended in parallel with the shafts 42 and 43. The points, which are spaced apart from the axes of the shafts 46 and 49 by the same distance between the axes of the shafts 42 and 43, of the connecting rods 48 and 51 are pivoted to shafts 47 and 50, respectively, which also are extended in parallel with the shafts 42 and 43 and hence the shafts 46 and 49. The other ends of the connecting rods 48 and 51 are pivoted to shafts 65 and 66, respectively, which in turn are journalled by spaced apart brackets 58 each having an extension 59 connected rigidly to the nozzle mounting block 36. Therefore the other ends of the connecting rods 48 and 51 are directed toward the sheet metal S as best shown in FIG. 7.

Figure 7:
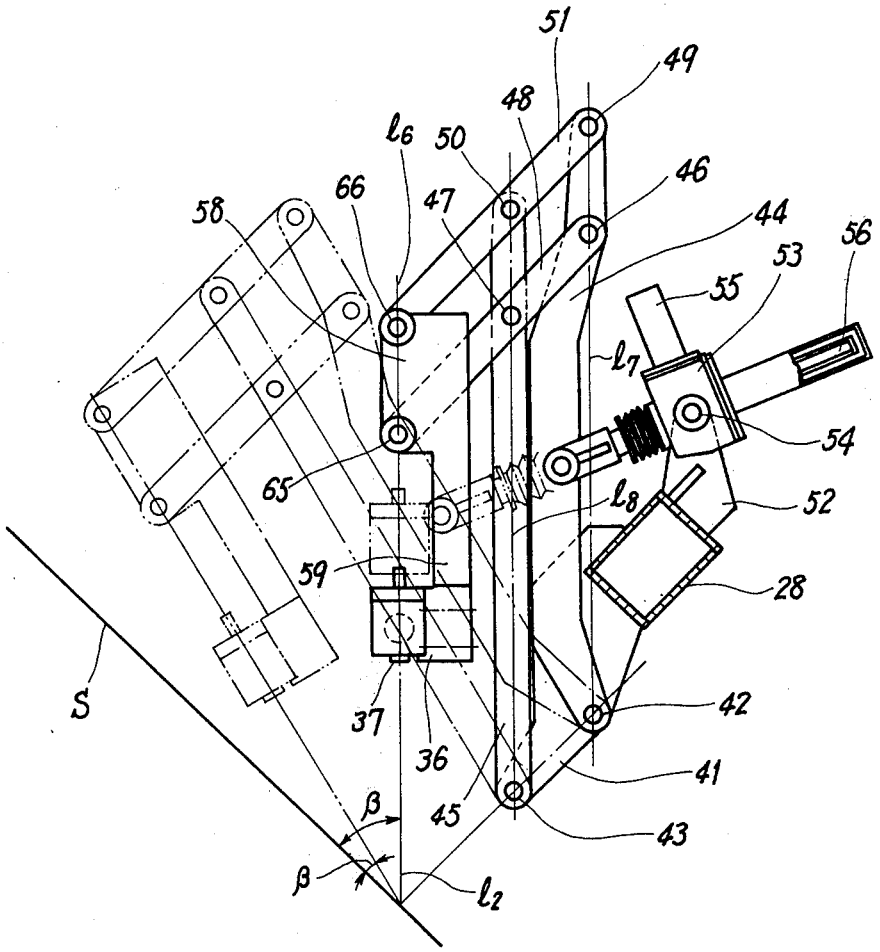
FIG. 7 is a view as viewed in the direction indicated by the arrows VII in FIG. 6.

As best shown in FIG. 7, a worm gearing or a reduction gear 53 is pivoted with pins 54 to brackets 52 which in turn are securely attached to and extended from the side wall of the supporting member 28 opposite to which are attached the brackets 41. The worm wheel of the reduction gear 53 is operatively connected to a motor 55, and one end of the worm shaft 56 is pivoted to the crank 44 about halfway between its ends. Therefore when the motor 55 is energized to drive the worm wheel in either direction, the worm shaft 56 is extended to the left in FIG. 7 or retracted toward the right so that the pantograph is swung about the axes of the shafts 42 and 43 and consequently the incident angle $\beta$ between the nozzle axis of each nozzle body 37 and the sheet metal S may be varied.

It is to be noted that the nozzle axis $l_2$ of each nozzle body 37 is in parallel with the line $l_6$ of centers between the shafts 65 and 66, the line $l_7$ of centers between the shafts 42, 46 and 49 and the line $l_8$ of centers between the shafts 43, 47 and 50. As with the first embodiment, the nozzle bodies 37 are so arranged that the line $l_3$ connecting the tips thereof is in parallel with the axes of the shafts 42 and 43. The nozzle axes $l_2$ of the nozzle bodies 37 intersect at Y the line $l_4'$ of intersection between the sheet metal S and the plane containing the axes of the shafts 42 and 43 as best shown in FIG. 6. Furthermore, the extension of the nozzle axis $l_5$ of the lowermost nozzle body 37 passes the point of intersection X between the line $l_4'$ and the extension of the shaft 34 on the centerline $l_1$ of the sheet metal S.

The angle $\alpha$ between the centerline $l_1$ of the sheet metal S and the nozzle axes $l_2$ of the nozzle bodies 37 may be varied in the manner described elsewhere. To vary the descaling slurry jet incident or impinging angle $\beta$, the motor 55 is energized so that the worm shaft 56 is moved to the left or right in FIG. 7. As a result, the pantograph is caused to swing about the axes of the shafts 42 and 43 in the counterclockwise or clockwise direction so that the incident angle $\beta$ is reduced as indicated by the broken lines in FIG. 7 or increased. However it is to be emphasized that the points Y at which the slurry jets are incident on or impinged against one or the other surface of the sheet metal S remain unchanged (See FIG. 7). Thus according to the second embodiment of the present invention, both the angles $\alpha$ and $\beta$ may be varied optimumly depending upon the descaling conditions.

THIRD EMBODIMENT, FIGS. 8 AND 9

Figure 6:
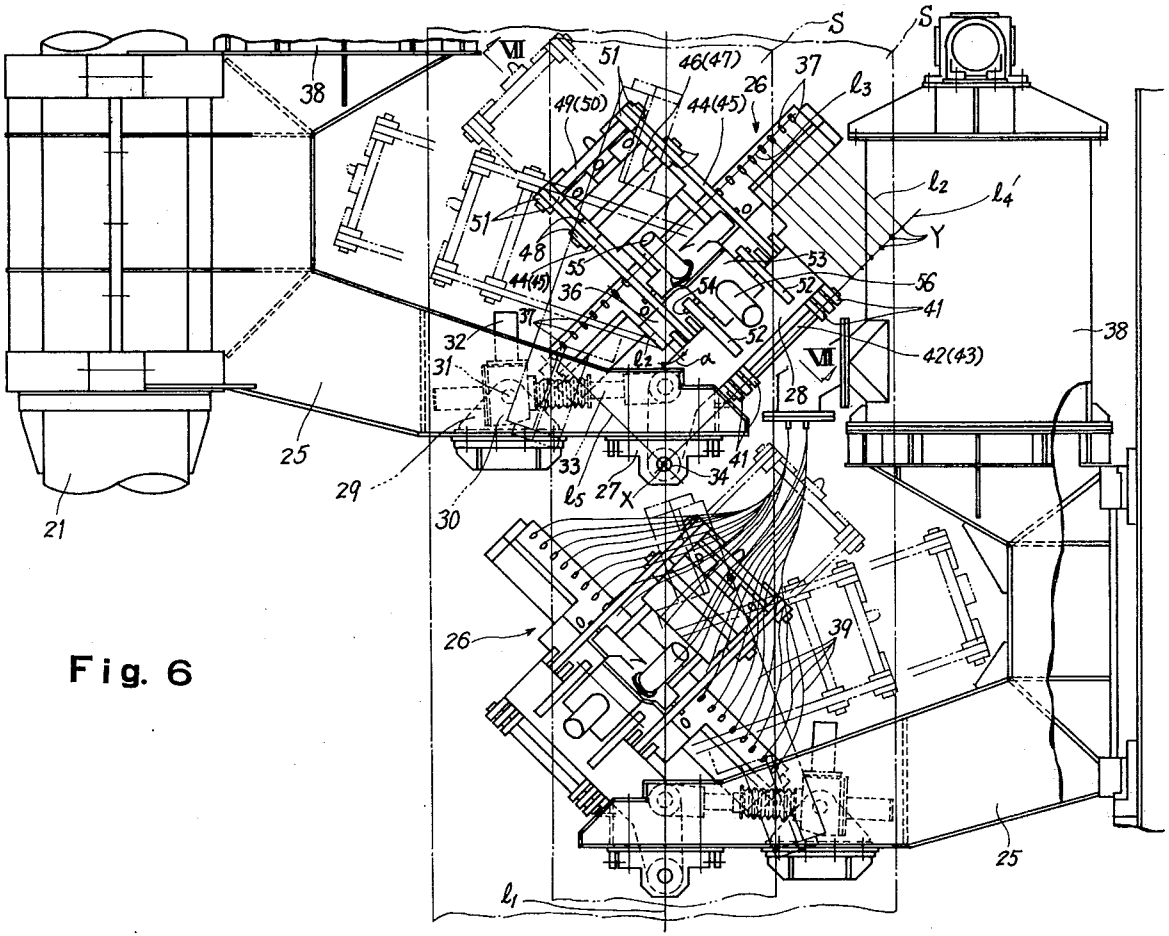
FIG. 6 is a fragmentary front view of a second embodiment of a mechanical descaling device in accordance with the present invention.
Figure 8:
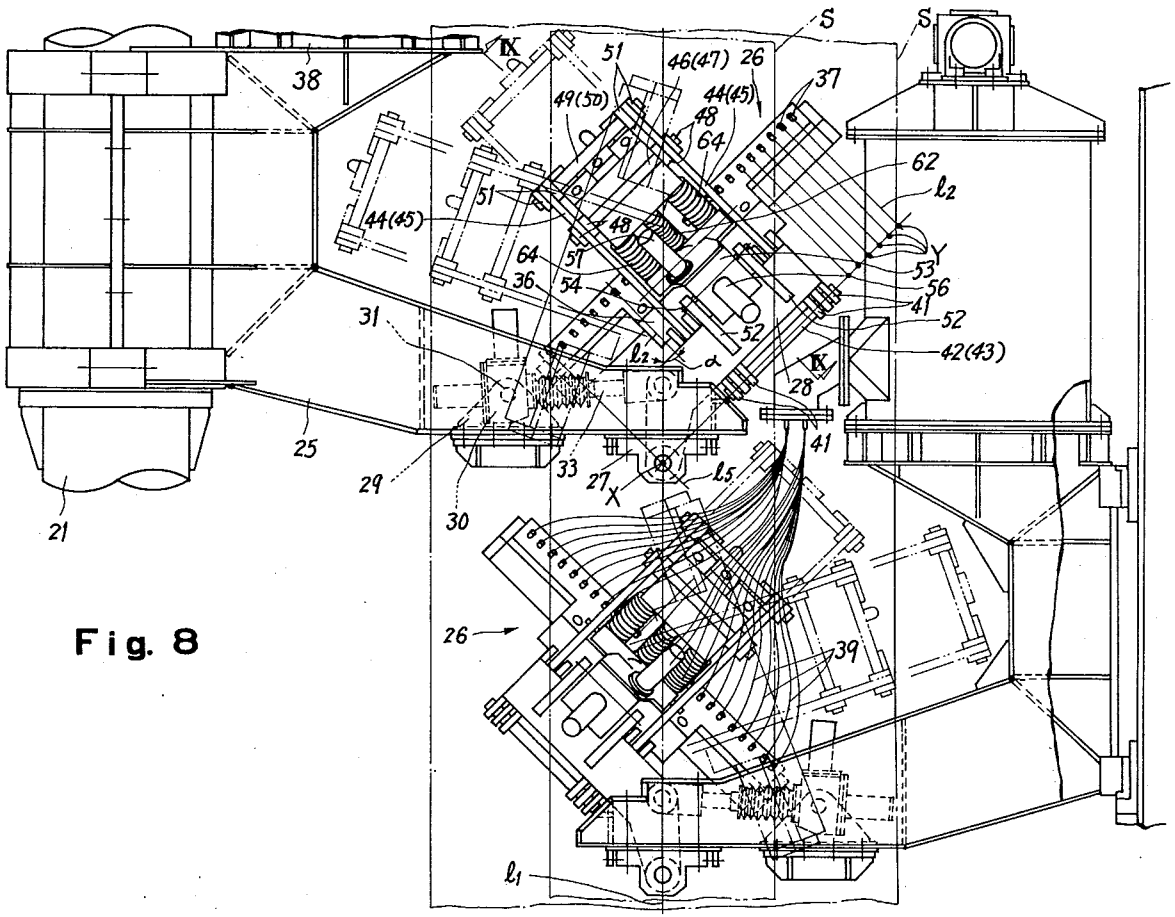
FIG. 8 is a fragmentary front view of a third embodiment of a mechanical descaling device in accordance with the present invention.
Figure 9:
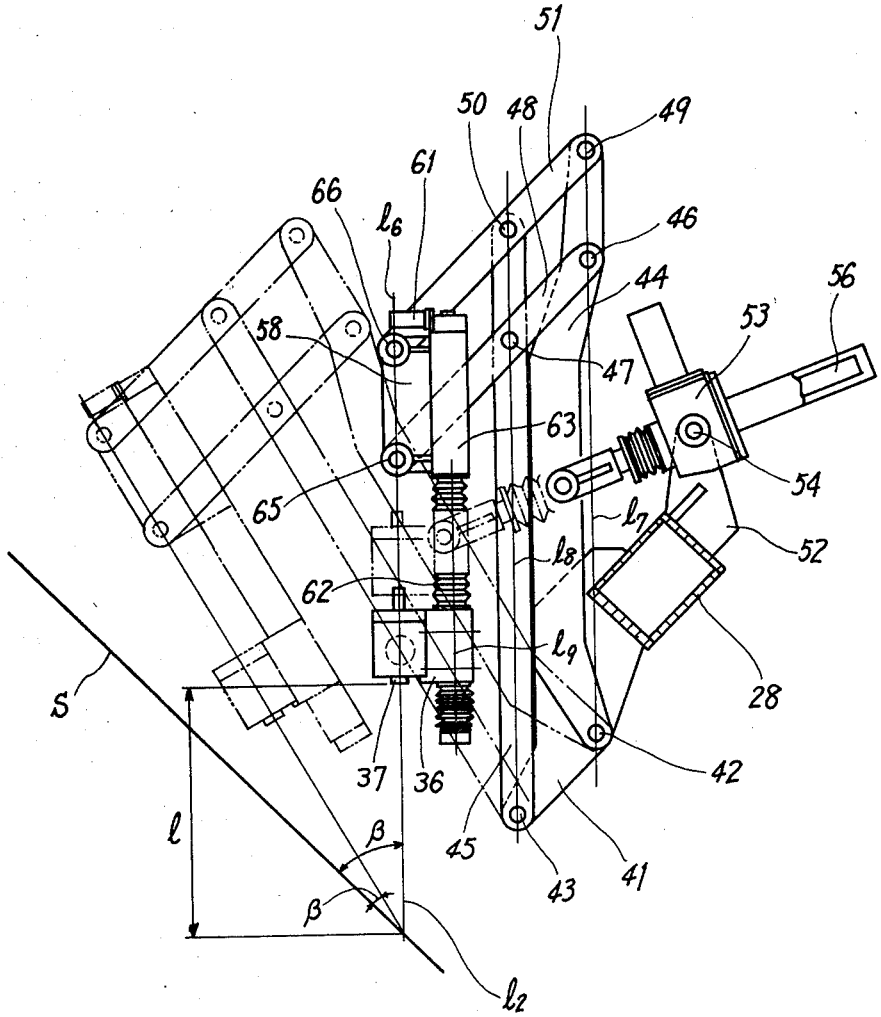
FIG. 9 is a view as viewed in the direction indicated by the arrows IX in FIG. 8.

The third embodiment shown in FIGS. 8 and 9 is substantially similar in construction to the second embodiment described hereinbefore with reference to FIGS. 6 and 7 except that means is provided to vary the distance l between the tips of the nozzle bodies 37 and one or the other surface of the sheet metal S.

Referring particularly to FIG. 9, a hollow cylinder 63 is securely attached to the bracket 58 in such a way that the axis $l_9$ of the cylinder 63 is in parallel with the line $l_7$ of centers 42, 46 and 49, the line $l_8$ of centers 43, 47 and 50 and the line $l_6$ of centers 65 and 66. A leading screw 62 is rotatably extended through the cylinder 63 and has its upper end operatively connected to a motor 61 so that the leading screw 62 may be rotated in either direction. The leading screw 62 is threaded into the nozzle mounting block 36.

The mounting block 36 is slidably mounted on guide rods 64 (See FIG. 8) extended in parallel with the leading screws 62 and spaced apart by a suitable distance therefrom outwardly. Bellows (See FIG. 8) are fitted over the guide rods 64 between the nozzle mounting block 36 and the brackets 58 so that the guide rods 64 may be free from the descaling slurries.

To vary the distance l between the tips of the nozzle bodies 37 mounted on the mounting block 36 and the sheet metal S, the motor 61 is energized to rotate the leading screw 62 in either direction. As a result, the nozzle mounting block 36 is moved upwards or downwards so that the distance l may be varied depending upon the descaling conditions. That is, the distance l may be selected optimumly depending upon the properties of the sheet metal S to be descaled.

In summary, the novel effects, features and advantages of the present invention are enumerated as follows:

(1) Optimum descaling conditions may be easily attained depending upon the properties and dimensions, particularly width, of the sheet metal. Inspection and maintenance may be carried out without stopping the cold rolled sheet production line. Therefore the productivity may be remarkably improved.

(2) Since no pickling acids are used, attacks on the sheet metal by acids may be completely avoided. Furthermore the devices for recovering and neutralizing the used acids may be eliminated. As a result, the installation cost may be drastically reduced. Furthermore, pollution problems due to the use of pickling acids will not arise.

(3) Depending upon the required surface conditions such as surface roughness, the descaling conditions may be easily and rapidly varied by changing the descaling slurry jet impinging angle $\beta$ and the distance l between the nozzle tips and the sheet metal.

(4) As compared with the production line including the pickling device, the overall length of the production line including the mechanical descaling devices in accordance with the present invention may be considerably reduced and consequently the capital cost may be drastically decreased. For instance, the conventional production line consisting of the pickling line and the cold rolling line extends as long as about 350 meters, whereas the length of the cold rolled metal production line consisting of the mechanical descaling devices of the present invention and the conventional cold rolling line is one half of the former. Therefore it is apparent that the considerable saving in capital cost may be obtained.

(5) The sheet metal emerging from the mechanical descaling device may be made to continuously and smoothly enter into the cold rolling line. As a result, the production time may be remarkably reduced and at the same time the required number of operators may be drastically reduced to $\frac{1}{3}$. For instance, the prior art production lines take in general a few days to cold roll the hot rolled sheet metal, but the production line incorporating the mechanical descaling devices in accordance with the present invention can reduce the production time to as short as a few hours.

(6) In the prior art production lines in which the pickling line and the cold rolling line are installed independently of each other, the devices are required for drying the sheet metal emerging from the pickling line and then applying an anti-corrosion oil. However, according to the present invention, these devices may be completely eliminated so that the running cost may be remarkably decreased.

What is claimed is:

1. A device for mechanically descaling at least one surface of a generally planar linearly-displaced metal sheet (S), comprising (a) a stationary frame (21, 22, 23, 25) arranged adjacent the path of travel of the metal sheet; and (b) at least one nozzle assembly (26) connected with said frame adjacent the sheet surface, each of said nozzle assemblies including (1) a nozzle support member (28);

(2) shaft means (34) connecting said support member with said frame for pivotal movement about a first axis (X) normal to the centerline ($l_1$) of the sheet;

(3) a plurality of parallel nozzle members (37) connected in equally spaced relation with said support member, (a) the tips of said nozzle members being contained in a common line ($l_3$);

(b) said nozzle members having parallel axes ($l_2$) contained in a common plane that (1) contains said common line, and (2) is arranged at a first angle ($\beta$) relative to the sheet surface; and (4) first drive means (32, 33) for pivoting said support member about said first axis to vary a second angle ($\alpha$) between said common line and the sheet centerline, whereby when a slurry is applied to said nozzle members to direct a plurality of descaling slurry jets against the sheet surface, the support member may be pivoted about said first axis to control the extent of the impingement area of the descaling slurry jets on the sheet surface.

2. Apparatus as defined in claim 1, and further comprising means for varying said first angle.

3. Apparatus as defined in claim 2, wherein said first angle varying means comprises (a) linkage means (44, 45, 48, 51) pivotally connecting said nozzle members with said support member; and (b) second drive means (53, 55, 56) for pivoting said linkage means.

4. Apparatus as defined in claim 3, wherein said nozzle members are arranged at a distance (l) from the sheet surface.

5. Apparatus as defined in claim 4, and further comprising means for varying the distance between said nozzle members and the sheet surface.

6. Apparatus as defined in claim 5, wherein said distance varying means comprises (a) threaded screw and cylinder means (62, 63) for connecting said nozzle members with said linkage means; and (b) drive means (61) for rotating said screw means, thereby to displace said nozzle members relative to said linkage means.

7. Apparatus as defined in claim 1, and further comprising (a) means for supplying a plurality of metal sheets to said frame, including in succession (1) means (1) for uncoiling a coil of hot rolled metal sheet;

(2) means (4) for welding the trailing edge of a preceding sheet to the leading edge of a succeeding sheet;

(3) means (6) for cutting the sides of the metal sheet, whereby the sheet has a uniform width; and (4) scale breaking means (9) for rolling the cut sheet under high pressure, thereby to true the configuration of the sheet and to break the scales on the sheet surfaces; and (b) means for rolling said descaled sheet, including in succession (1) means (11) for cleaning the sheet surfaces;

(2) a cold rolling line (12) for rolling the sheet;

(3) means (14) for cutting the sheet with individual sheets of desired length; and (4) means (15) for recoiling the cold rolled sheets.

8. Apparatus as defined in claim 7, wherein said sheet supply means includes accumulator means (16) for accumulating a length of the sheet emerging from said scale breaker means.

* * * * *